US009204701B2

(12) United States Patent
Daneshvar

(10) Patent No.: US 9,204,701 B2
(45) Date of Patent: Dec. 8, 2015

(54) DANESHVAR DIFFERENTIAL HAIR COLORING AND METHODS

(75) Inventor: Yousef Daneshvar, West Bloomfield, MI (US)

(73) Assignee: AMERICAN MEDICAL CORPORATION

( * ) Notice: Subject to any disclaimer, the term of this patent is extended or adjusted under 35 U.S.C. 154(b) by 2451 days.

(21) Appl. No.: 11/717,529

(22) Filed: Mar. 13, 2007

(65) Prior Publication Data

US 2007/0215169 A1 Sep. 20, 2007

Related U.S. Application Data

(60) Provisional application No. 60/783,764, filed on Mar. 20, 2006.

(51) Int. Cl.

| | |
|---|---|
| ***A45D 19/06*** | (2006.01) |
| ***A45D 19/02*** | (2006.01) |
| *A45D 19/00* | (2006.01) |
| *A45D 24/16* | (2006.01) |

(52) U.S. Cl.

CPC ..... *A45D 19/02* (2013.01); *A45D 19/06* (2013.01); *A45D 19/0008* (2013.01); *A45D 24/16* (2013.01); *A45D 2019/0091* (2013.01)

(58) Field of Classification Search

CPC ..... A45D 19/02; A45D 19/06; A45D 19/008; A45D 19/00; A45D 2019/0066

USPC ..... 132/120, 112, 125, 126, 139, 142

See application file for complete search history.

(56) References Cited

U.S. PATENT DOCUMENTS

| | | | | |
|---|---|---|---|---|
| 2,167,196 | A * | 7/1939 | Bothum | 15/236.05 |
| 2,175,344 | A * | 10/1939 | Friedman | 132/137 |
| 4,585,018 | A * | 4/1986 | O'Connor | 132/120 |
| 5,337,765 | A * | 8/1994 | Wong | 132/120 |
| 5,555,899 | A * | 9/1996 | Foreman | 132/114 |
| 5,765,253 | A * | 6/1998 | Martinez | 15/160 |
| 5,983,437 | A * | 11/1999 | Wakat | 15/230.11 |
| 6,079,420 | A * | 6/2000 | Musum | 132/125 |
| 6,539,949 | B2 * | 4/2003 | Christensen | 132/114 |
| 6,793,434 | B1 * | 9/2004 | Olson | 401/286 |
| 7,461,659 | B2 * | 12/2008 | Glynn et al. | 132/108 |
| 7,475,688 | B2 * | 1/2009 | Colacioppo et al. | 132/126 |
| 2006/0283472 | A1 * | 12/2006 | Kelloyan | 132/120 |

* cited by examiner

*Primary Examiner* — Robyn Doan

(57) ABSTRACT

A brush for applying hair dye to hair or removing hair dye from hair has a base, multiple dye-holding units disposed on the base, and a handle that extends from the base for grasping by a person's hand. Various embodiments of dye-holding units are disclosed, one of which has an absorbent medium disposed on a stem that is mounted on the base. The dye-holding units of the brush are arranged on the base in a pattern comprising multiple side-by-side rows with each row comprising multiple brush units. A dye-holding pan has multiple open-top receptacles for holding hair dye. The receptacles are arranged in a pattern that allows brush units in each of multiple rows to be inserted into the receptacles on a basis of only one dye-holding unit to one receptacle.

10 Claims, 11 Drawing Sheets

DANESHVAR DIFFERENTIAL HAIR COLORING AND METHODS

REFERENCE TO A RELATED APPLICATION

This application incorporates by reference and claims the priority of the provisional application No. 60/783,764 filed on Mar. 20, 2006.

BACKGROUND OF THE INVENTION

Coloring of hairs are common for beautification, religious reasons and expression of choices. Commonly, one colored hair dye is applied to the hairs which leaves a uniform color of the hairs. However, coloring the hairs uniformly with one color is not ideal in certain conditions, for example when the person wishes to have shades of a hair color to match the changes that happens with age, then a uniform color will be unwanted. Also in a circumstance when a person wishes to have a more artistic hair coloring again a uniform hair coloring will not be ideal. For these reasons this application introduces methods and means that allow differential coloring of hairs to be possible in a living body. In this subject, also other related issues will be also addressed for example the process of coloring the hairs needs to be advanced to remove certain difficulties.

SUMMARY OF THE INVENTION

In this application the applicant introduces a special, hand-held brush means that allows a predicted amount of hair dye to be carried from a pan to the hair and applied. To do this, the special brush means has a series of brush units that are capable of holding and carrying a predicted amount of the hair dye from a source for being delivered to the hairs, without dripping and contaminating the surrounding. This method provides multiple advantages: first, it allows the application of the dye to the hair to be easy, second, it allows some groups of the hairs to be spared from being dyed. Third, it also allows some of the hair dye which was already applied to the hairs to be removed, so that finally the hairs will have different groups, some which has received full dose of the hair dye and others with much lesser or no hair dye and a third group which has different shades of the hair dye on them. Thus at the end this method allows the hairs to have multiple shades of the hair dye on them and look different than having a universal coloring. This application also allows two or more hair dyes to be applied at one time for creation of different over all hair coloring. Lastly, in this method the contamination of the surrounding by the dye will be none or far lesser than other methods. Methods of use in this application provide other benefits that are explained. Also other methods are introduced.

DETAILED EXPLANATION OF THE FIGS

Figure 1:
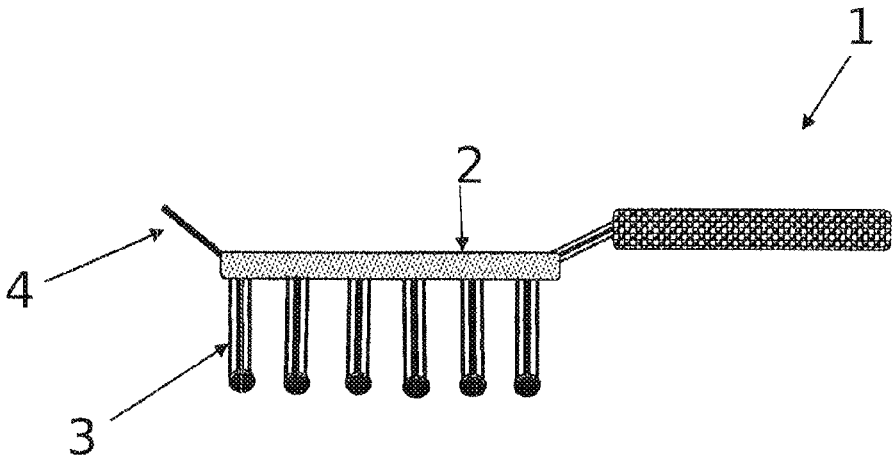
FIG. 1. shows a special brush means designed for carrying a predicted amount of the hair dye.

FIG. 1 shows schematically a special brush means that has a base 2 for holding a series of special brush units 3 on its surface. The brush units are designed to hold and carry a predicted amount of the hair dye and are shown in more details in FIGS. 10-12. This unit has a handle 1 for holding the brush means and also a blade means 4 in its end. The blade means is for wiping the dye around which is poured inside a special space, dye pan, 7 shown in FIG. 2.

Figure 2:
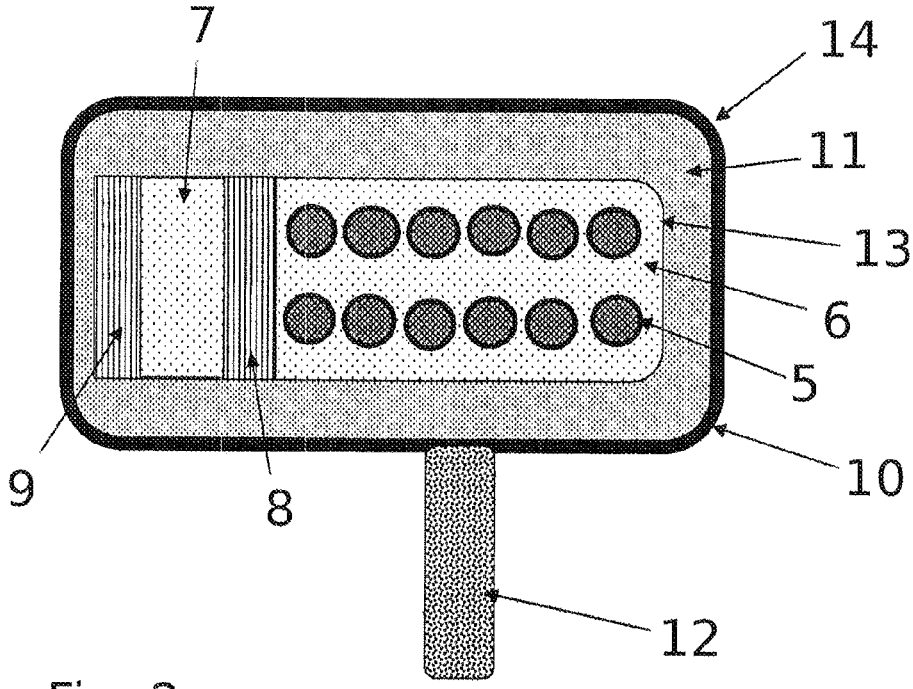
FIG. 2 shows tray means that allows a predicted amount of dye to be attached to the brush means of the unit shown at FIG. 1.

FIG. 2. shows schematically a tray means that consists of different parts as follows:

a. a series of cylindrical empty spaces 5 designed to allow each single brush unit 3 of the brush means shown at FIG. 1 to be inserted inside a cylindrical space 5 for being immersed in dye filling these spaces so that when the brush means is removed, each brush unit 3 will be covered with a predesigned amount of the hair dye. Thus, the numbers of the cylindrical spaces 5 will match the numbers of the brush units 3 from the brush means.

b. A floor 6 which is a flat layer with a flat surface that the cylindrical spaces are attached to.

c. The front part of the floor 6 has a dye pan 7 that acts like a tiny pan so that the hair dye can be emptied inside it for use. This dye pan 7 has a front and a rear flat surface which are like ramps 8 and 9. Ramp 8 is between the rear border of the dye pan 7 and the front border of the floor 6. Ramp 9 is located between the front border of the dye pan 7 and the rear border of the floor 6. These ramps allow the blade 4 of the brush unit shown at FIG. 1. to pull the dye from the dye pan 7 to the flat surface area of floor 6 in order to pull the dye further for filling up the cylindrical spaces 5.

d. A second, flat floor 11 which stands one level above the first floor 6 and has a side wall 10 which prevents that dye from spilling out of this unit.

e. The surrounding wall 10 is vertically attached to the border of the second floor 11 and thus it prevents the dye from being spilled out of the second floor 11 of this unit. This is also shown at FIG. 4.

f. A handle 12 that attaches to the side wall 10 or similar area and allows this unit to be held.

Figure 3:
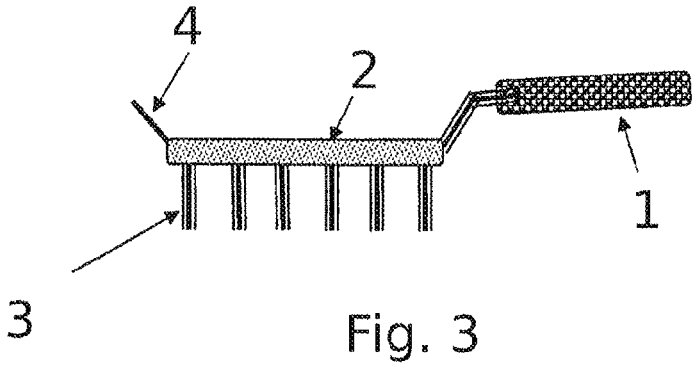
FIG. 3 shows a brush means similar to the unit shown at FIG. 1 for use with the dye delivery tray means, shown at FIG. 4.
Figure 4:
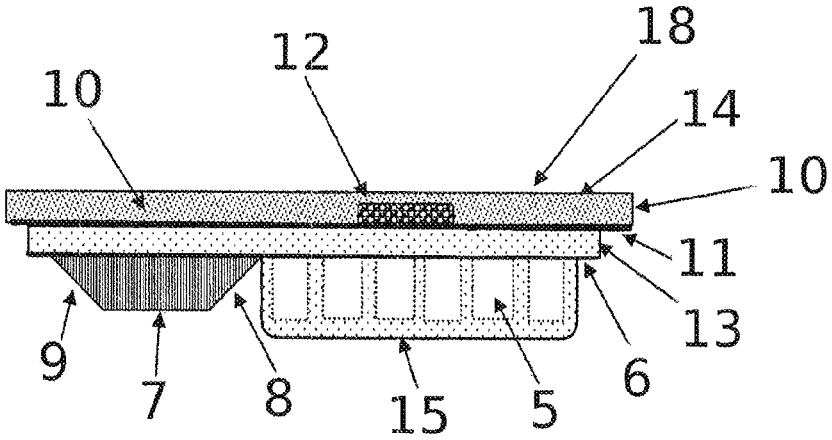
FIG. 4. shows the side view of the dye delivery tray means shown at FIG. 2.

FIG. 3 shows schematically a brush means similar to the unit shown at FIG. 1 and designed to match and be used with the dye delivery tray means shown at FIG. 4.

FIG. 4 shows schematically the side view of the dye delivery tray means shown at FIG. 2. FIG. 4 shows two pools, which are made by having a wall means 13 and 10 around the floors 6 and 11 respectively so that the wall means prevents the dye from spilling out of these pools.

The cylindrical spaces 5 are attached to the floor 6. Again each cylindrical space allows one brush unit 3 of the brush means shown at FIGS. 1 and 3 to be inserted inside these cylindrical spaces in order to be immersed in the dye filling these spaces. The pool surrounded by wall means 10 stands above the pool surrounded by wall means 13. The handle 12 is attached to the side of wall means 10.

In the front part of the floor 6, the dye pan 7 has ramp 8 that allows the blade 4 from the brush unit to pull the dye from the dye pan onto the surface of floor 6 in order to fill up the cylindrical spaces 5.

This unit will be made from a rigid material such as metal or synthetic material. Although it can be used alone but mainly this is a cradle for a disposable matching insert shown at FIG. 5.

Figure 5:
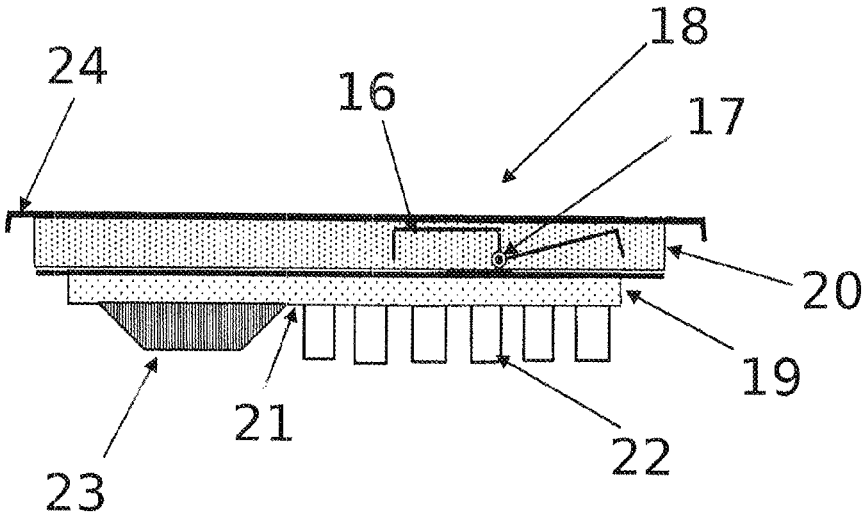
FIG. 5 shows a disposable matching insert that fits the cradle shown at FIG. 4.

FIG. 5 shows a disposable matching insert, made from a thin polymer, such that simply its body and size matches and fits inside the cradle shown at FIG. 4. Thus the shape of the outer surface of the insert will be almost exactly similar to the shape of the inner surface of the durable unit. Except it will be a shade smaller so that the placement of the insert inside its cradle can occur. Due to its all over thin body the shape of the inner surface of the cradle will be about the same as its outside. The insert will have an overlapping edge so that it will overlap the outer side wall 10 of the body of durable unit and thus it will prevent contamination of the edge of the durable unit with the dye. The purpose of this insert is as follows.

1. It makes the use of these units easier, and will save time and money, since the user does not need to use water for washing the cradle unit shown at FIG. 4.
2. This makes these units economical, since a thin disposable piece will be cheap and affordable.
3. This makes these units clean and hygienic, since the thin disposable piece will be disposed after use and thus will eliminate or decrease the chance of spread of germs and diseases.

These inserts simply match the inside surface of the hard unit shown at FIG. 4 and will simply fit inside. A handle cover 16 will go over the handle and has a door means hinged to it that will cover the lower surface of the handle and snap to its own wall so that even the handle part will be covered as well. Each part of this unit has a matching piece that will fit the parts of the unit shown at FIG. 4. The wall of this unit will overlap the side wall 10 of the unit shown at FIG. 4.

Figure 6:
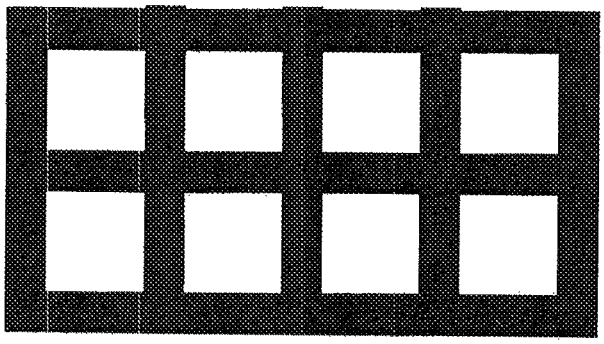
FIG. 6 shows top view of a dye pan made by dividing a container into small spaces by use of walls.

FIG. 6 shows schematically the top view of a simpler dye pan that has dividing walls that make small spaces by dividing a pan into small spaces by use of the walls. This figure is shown to indicate that other sorts of dye pools may be made for use, although the model shown at FIG. 2 has the advantage which provides more distance between the cylindrical spaces 5 and allows the dye to be used with the smallest amount that is needed.

Figure 7:
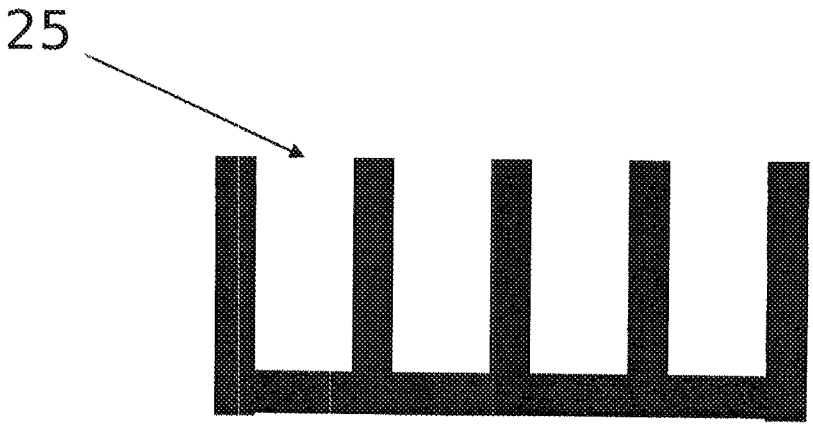
FIG. 7 shows schematically the cross cut view of the dye pan means shown in previous FIG. 6.

FIG. 7 shows schematically the cross cut view of the dye pan means shown in previous FIG. 6. In this view the small spaces 25 are shown made by use of walls.

Figure 8:
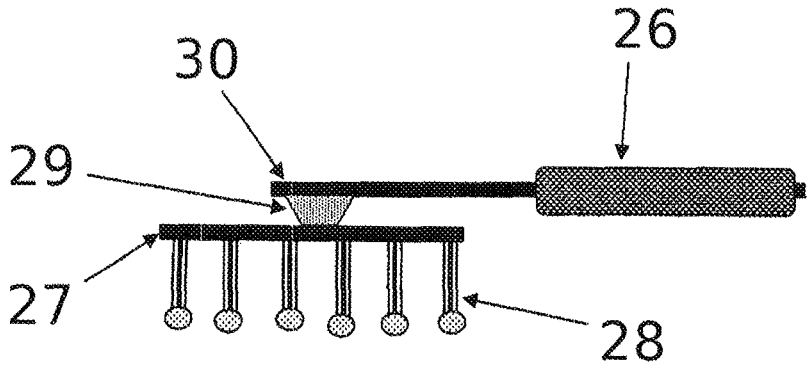
FIG. 8 shows schematically a brush means that has a re-useable handle means.

FIG. 8 shows schematically a method that allows the brush means to have a re-useable handle means 26 with disposable brush means 27 so that the handle means can be reused and the brush means can be disposed. This method has the advantage of using a durable, deluxe, handle means and saving money. In this model the durable handle means 26 attaches to the body of a disposable base 27 which holds a series of the special brush units 28 on it. The re-useable handle means 26 has an attachment means 29 at its end 30. The attachment means allows the body of a disposable base 27 to be separated from the handle and allow a fresh unit to be attached for use. This method allows lesser amount of the material to be wasted as well.

Figure 9:
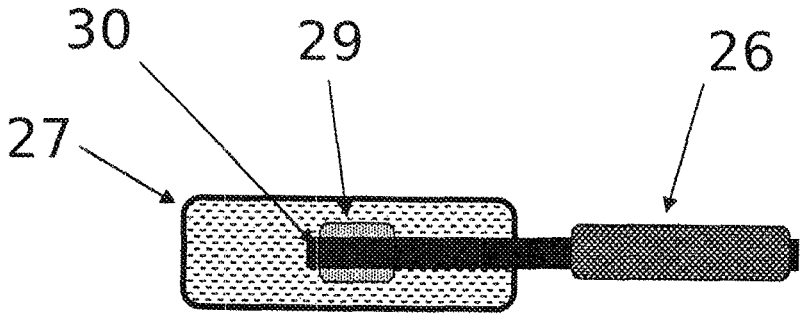
FIG. 9 shows the top view of the unit shown at previous FIG. 8.

FIG. 9 shows schematically the top view of the unit shown at FIG. 8. In this Fig. the re-useable handle means 26 is attached to the body of a disposable base 27 by use of the attachment means 29.

In another model shown at FIGS. 14-17, the base of the unit has a double-sided surface that allows the brush means to be on its upper and lower faces. The unit can made be made with more than two faces with brush means such as three, four etc.

Figure 10:
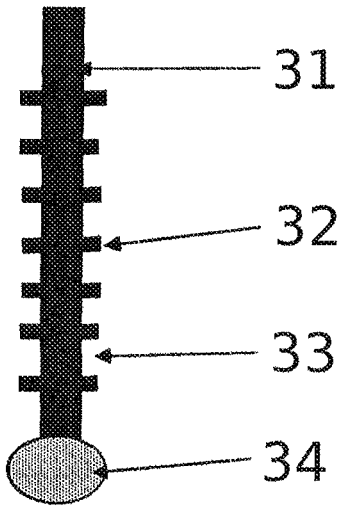
FIG. 10 shows the side view of a brush unit which has a stem with a series of walls around it.

FIG. 10 shows schematically the side view of a single special brush unit which has a body or a stem shown at 31 with a series of short, circular walls 32 that are located around the stem 31 and are perpendicular to it. The presence of walls close to each other creates a space 33 between them so that it will hold a pre-designed amount of dye in it, due to the consistency of the dye. The free end of the brush unit has a rounded head 34 so that it will not scratch the skin. Importantly, instead of the walls the stem may be made to have other means such as.

a. Short, multiple side branches.
b. Spikes.
c. Indentations
d. Holes or openings.
e. Spaces.

or any other means to increase the surface of the stem and modify its surface to allow the temporary attachment of the dye to the stem and its parts and the surfaces for delivery to the intended area.

Importantly, any other means and modification which will be useful in the purpose may be used to make such units applicable.

Figure 11:
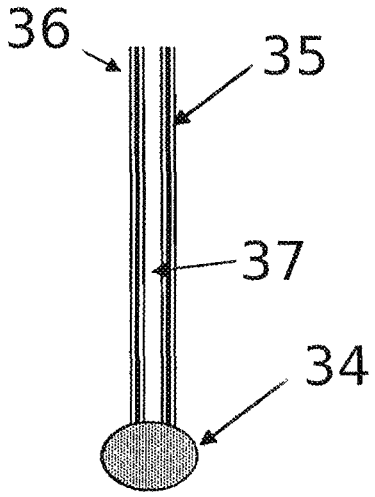
FIG. 11 shows the side view of another brush unit which has a body or stem that consists of a combination of two separate stems with a distance between them.

FIG. 11 shows schematically the side view of another brush unit which has a body that consists of a combination of two separate stems 35, 36 with a distance between them shown at space 37 so that the surfaces of the stems and the adjacent space between them will hold a predesigned amount of the dye for delivery. The end of the brush unit also has a round head 34 so that it will not scratch the skin.

Figure 12:
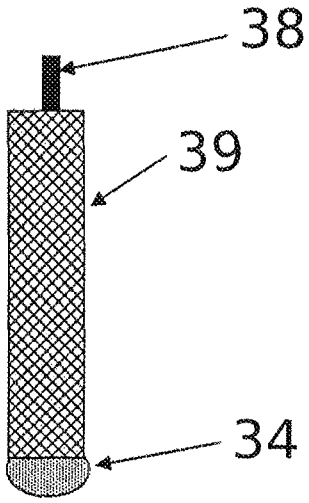
FIG. 12 shows a brush unit which has a stem covered with a layer of absorbent material.

FIG. 12 shows schematically the side view of yet another brush unit which has a stem 38 made from metal or hard, resilient material that is covered with a layer of absorbent material such as the cotton shown at 39. The free end of this brush unit also has a round head 34 to prevent scratching of the skin. This model allows the following.

1. This unit can be immersed inside a pan of dye so that when removed, it will hold a predicted amount of dye for allowing it to be taken and delivered to the hairs.
2. Importantly, when used in a dry form, it can be brushed thorough a hair group which are covered uniformly with a hair dye, in order to absorb the dye. By this process the absorbent material will absorb an amount of hair dye during its passage through the hairs. By doing so it will remove the dye from certain hairs and will prevent them from being dyed on a uniform fashion, thus it will create a differential coloring. Naturally, the amount of the dye removal will depend on, a. The number of the times which a dry brush is moved through the hair groups.

b. The thickness of the absorbent material.

c. The nature of the absorbent material.

The width of the brush unit may vary so that with the rotation of the stem of the brush unit the exposure of the brush unit to the hairs can be changed.

This can be adjusted in order to allow the user to choose the amount of the dye which he/she wants to remove in the process.

Figure 19:
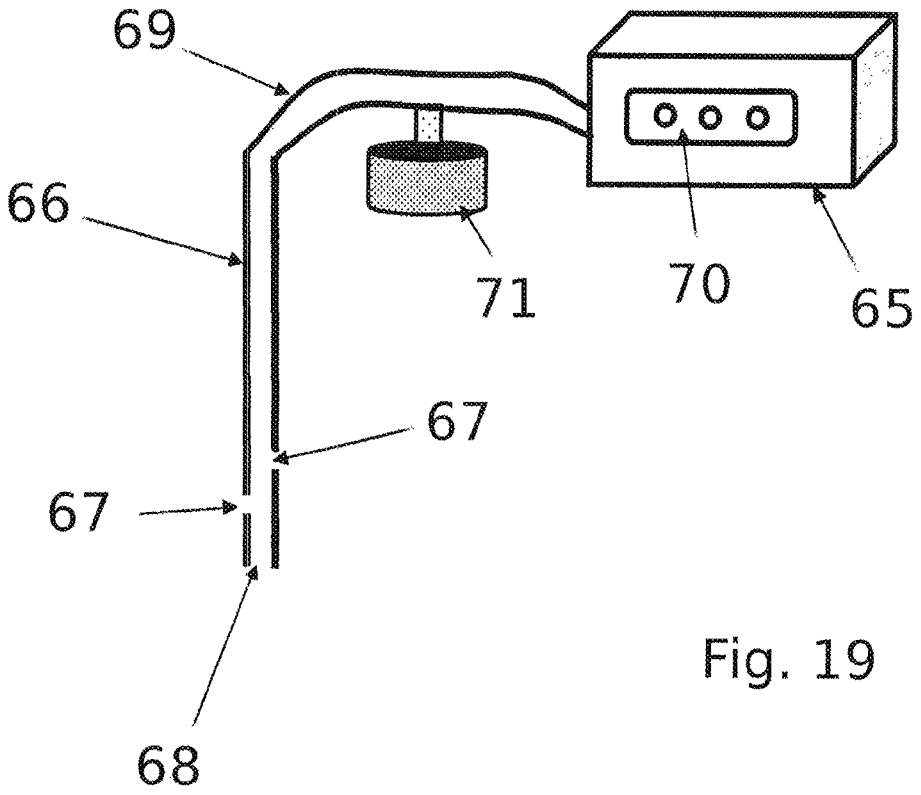
FIG. 19 shows a brush unit made from a tube with holes in sides and in its tip to allow the dye to move in and out.
Figure 20:
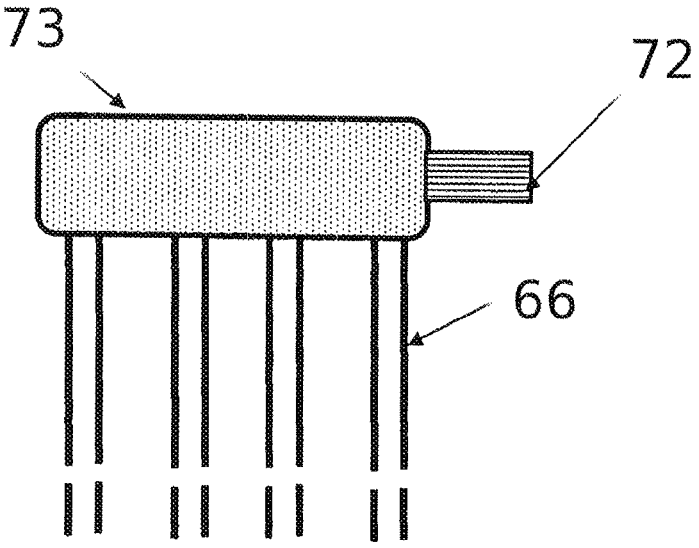
FIG. 20 shows a brush means with a hollow body and with multiple brush units.

Other models of brush units shown at FIGS. 19 and 20 consist of a tube with openings. The openings will allow the dye to get in and out of them for the intended use.

Figure 13:
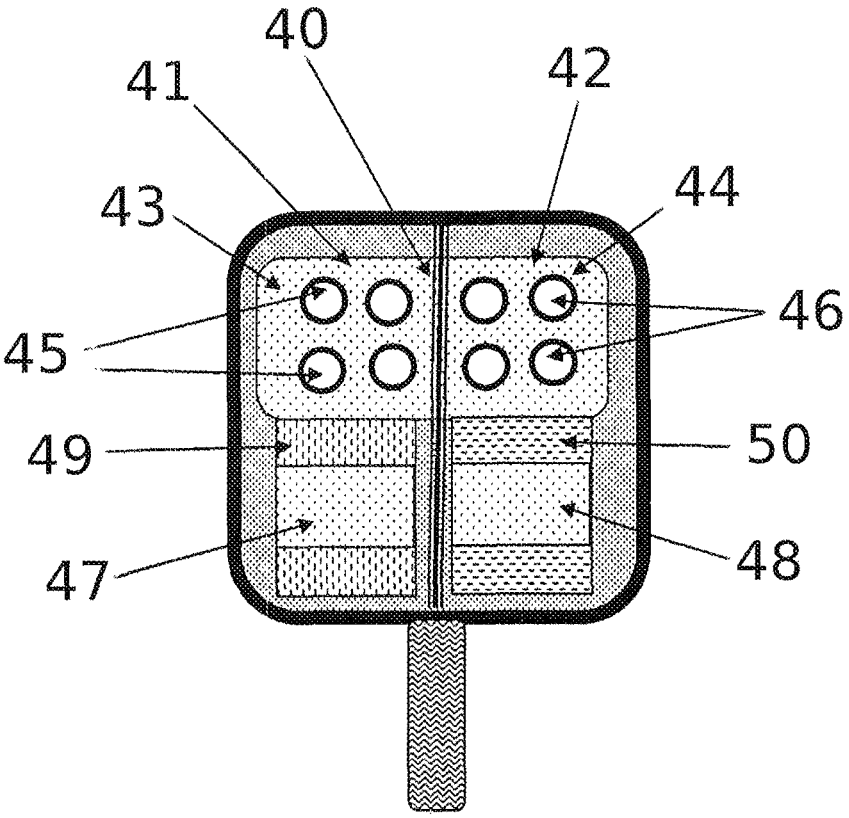
FIG. 13 shows a tray means that consists of a combination of two independent areas for delivering the dye.

FIG. 13 shows schematically a pan means that consists of a combination of two independent dye pools for delivering two different dyes. This unit consists of rather two identical delivery systems that are divided by a separating wall 40. Each one is similar to the dye delivery system shown at FIG. 2. Thus this unit has the following.

a. a series of cylindrical empty spaces 45 and 46 that are designed to allow each single brush unit of the brush means shown at FIG. 1 to be inserted inside these cylindrical spaces in order to be immersed in the dye filling these spaces so that when the brush means is removed from the cylindrical spaces, each brush unit will be covered with a special, predesigned amount of the hair dye. Thus the numbers of the cylindrical spaces 45 and 46 will match the numbers of the brush units from the brush means.

b. A floor 43 and 44 which is a flat surface that the cylindrical spaces are attached to.

c. Each floor has an associated pan for holding the dye, shown at 47 and 48, which will allow a different colored hair dye to be emptied into each one. A higher floor and wall similar to the unit shown at FIG. 2 will be utilized to allow this unit to be functional. The advantage of this unit is that it allows two different colors of hair dye to be placed and to be utilized with:

1. A brush that will be used once with first dye in spaces 45 and then with the second dye in spaces 46.
2. Or with a brush that has enough numbers of the brush units that will allow half of the brush units to be used with the first dye in spaces 45 and the other half with the second dye in spaces 46.
3. The blade of the brushes may be placed in the side in order to allow the wiping of the dye to be done easily.

The ramps and the other parts will mimic the unit shown at FIG. 2.

The use of two dyes with different colors will allow two colors and shades of these two colors to be applied to the hairs and prevent a uniform coloring. Importantly, more than two colors may be used with utilizing this method.

Figure 14:
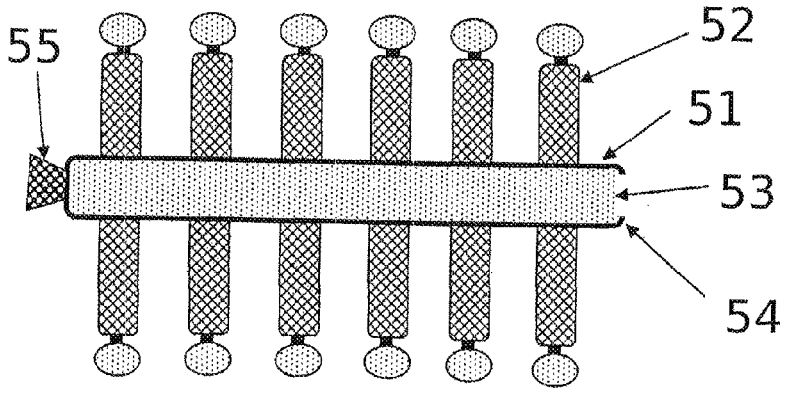
FIG. 14 shows a disposable body of a brush means that is designed for use with a re-useable handle means shown at FIG. 15.
Figure 15:
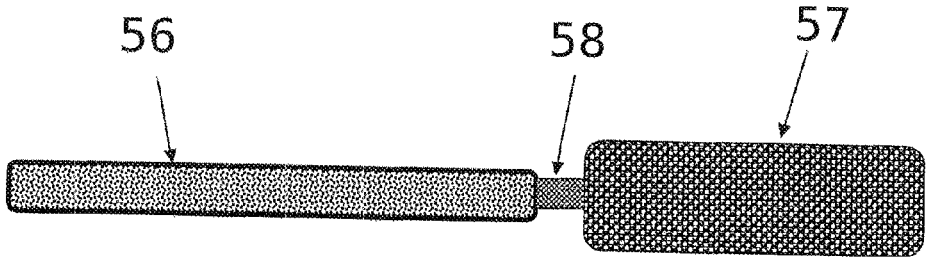
FIG. 15 shows a re-useable handle means, designed to be inserted into the body of the brush means shown at FIG. 14.

FIG. 14 shows schematically a disposable body of brush means that is designed for use with a re-useable handle means shown at FIG. 15. In this model the body of the brush means 51 is made of a hollow flat unit such as a rectangular cuboid made from a relatively rigid means that holds a series of brush units 52 on its upper and lower surfaces. This unit allows a re-useable handle means 57 shown at FIG. 15 to be inserted inside the hollow part of this unit in order to be functional. This re-useable handle means has an insert part 56 that matches and fits inside the inner hollow space of the unit shown at FIG. 14. The tip of the insert part 56 will be pushed into the opening 53 of the unit shown at FIG. 14. The sides of the body of the brush means have clip means 54 that will engage the zone between the neck 58 and the body of the insert part 56 from the handle means shown at FIG. 15. This engagement will prevent the body of the brush means 51 from being removed unless it is pulled out by force by holding the end piece 55 designed for being held and pulling the body of the brush means 51 away from the insert 56. The handle means has a handle that allows it to be held. This method allows the user to use a disposable brush means for the delivery and removal of the dye on the hair. One side of the brush means may be used for the delivery of the dye first and the other side may be used for the removal if desired. Importantly, the unit may have four sides covered with the brush means.

Figure 16:
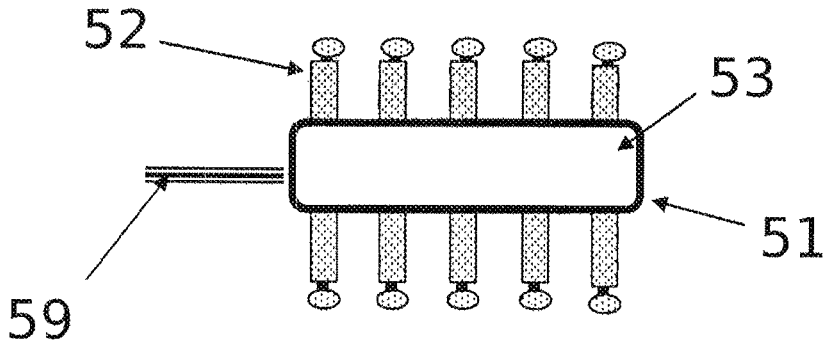
FIG. 16 shows the cross cut side view of the disposable body of a brush means, similar to one shown at FIG. 14.

FIG. 16 shows schematically a cross cut side view of the body of the disposable brush means 51 similar to the one shown at FIG. 14. In this figure the body of the brush means 51 is shown with its hollow opening 53 that allows the insert 56 of the handle means 57 of the unit shown at FIG. 15 to be inserted inside it. The brush units 52 are attached to the outer surface of this unit.

DETAILED EXPLANATION OF THIS INVENTION

The coloring of hairs is common for reasons, such as beautification, religious reasons and expression of choice. Commonly, a single hair dye is applied to the hairs which leaves a uniform color of the hairs. However, this is not ideal in certain conditions, for example when the person wishes to have shades of hair coloring to match the changes that happens with age. Also in another circumstance when a person who wishes to have a more artistic hair coloring than a uniform hair color. For those reasons this application introduces a method and means that allow this differential coloring to be possible. In this application the applicant introduces a hand-held brush means that allows a predicted amount of hair dye to be carried to the hair and applied. This can be done by use of a brush means that has a series of brush units that are capable of holding a predicted amount of the hair dye for being taken to be delivered to the hairs. This method has the advantages that first, it allows the application of the dye to the hair to be easy, and second, it allows some groups of the hair to be spared from being dyed. Third, it also allows some of the hair dye which was already applied to the hairs to be removed, thus finally the hairs will have different groups, some which has received full dose of the hair dyes and others with much lesser hair dye and a third group which has different shades of the hair dye on them. Thus at the end this method allows the hairs to have shades of the hair dye on them and to look different than having a universal coloring. This application also allows two or more hair dyes to be applied at one time for creation of different overall hair coloring. For understanding this method and means the applicant reviews the figures. FIG. 1 shows schematically a brush means that is designed to allow a predicted amount of hair dye to be carried from a unit referred as the hair dye pan to the hair. This brush means has a base 2 which holds a series of special brush units 3 on it. It has a handle 1 and also has a blade in its end. The brush units are explained more in FIGS. 10-12. The main functions of these brush units are:

A. To hold and carry a pre-designed amount of dye on their bodies so that in general the hair dye will not drip.

B. The free end of the brush unit has a round head so that it will not scratch the skin.

C. In some models such as one shown at FIG. 12 the brush unit is made from a body or stem that is covered with a layer of absorbent material such as the cotton shown at 39 so that this construction allows the following.

1. If it is immersed inside a pan of dye, it will hold a predicted amount of the hair dye and will allow it to be taken and delivered to the hairs without dripping.
2. Importantly, when it is not used and is dry, it can be brushed thorough scalp with hairs that are covered totally with a hair dye and will absorb the hair dye during its passage among the hairs. Thus it will remove the dye from the hairs that comes in contact with it, and will prevent them from being dyed uniformly. Thus it will be useful in creation of a differential hair coloring. The free end of this brush unit also has a round head so that it will not scratch the skin.

The brush means will have different numbers of these brush units in order to serve the purpose of the user.

The brush means also has a blade means as shown which is designed for wiping the dye in the dye pan of the tray means shown in FIG. 2.

The tray means is designed for use with the brush means. FIG. 2 shows schematically a tray means that consists of different parts as follows.

a. a series of cylindrical empty spaces 5 that are designed for allowing each single brush unit 3 of the brush means shown at FIG. 3 to be inserted inside these cylindrical spaces in order to be immersed in the dye which fills these spaces so that when the brush unit is removed from these cylindrical spaces, it will be covered with a predesigned amount of the hair dye. Thus the numbers of the cylindrical spaces 5 will match the numbers of the brush units 3 from the brush means. The number of the brush units can be less than the numbers of the cylindrical spaces but they cannot be more than those.

b. A floor 6 which is a flat surface to which the cylindrical spaces are attached.

c. The front part of the floor 6 has a dye pan 7 so that the hair dye can be emptied into it for use. Dye pan 7 has front and rear lower surfaces which are sloped so that it allows the blade 4 from the brush unit to pull the dye from the space of the dye pan onto the flat surface 6 in order to fill up the cylindrical spaces.

d. A second floor 11 which is also a flat surface that stands above the first floor 6 and prevents dye from spilling out of this unit.

e. A handle 12 allows this unit to be held.

FIG. 3 shows schematically a brush means similar to the unit shown at FIG. 1 and designed to match and be used with the dye delivery tray means in FIG. 4.

FIG. 4 shows schematically the side view of the dye delivery tray means shown at FIG. 2. This figure shows two pools which are similar to a pan, each having a flat floor and a surrounding wall. The combination of these are like having one smaller pan under a longer and wider pan with a portion of the floor of the bigger pan which overlies the smaller pan removed to connect the spaces of these two pans together. There are wall means 13 and 10 around the floors 6 and 11 respectively to create the pan means and prevent the dye from spilling out of these pools.

The cylindrical spaces 5 are located in the floor of the lower pan 6. Each cylindrical space accepts one brush unit of the brush means shown at FIGS. 1 and 3 for being immersed in the dye which is fills these spaces. The longer and wider pan stands above the smaller one and each has its own wall. The handle means 12 is attached to the side of the longer and wider pan.

The front part of the floor 6 has a dye pan 7 that has sloped front and rear walls that allow the blade 4 from the brush unit to sweep the dye from the flat floor of this space into the surface of the floor 6 in order to fill up the cylindrical spaces.

This unit is made from a rigid material such as metal or synthetic material and it can be used alone and serve the purpose except the problem is that after use it would need to be washed. For this reason the main design is to use this unit as a cradle for a matching disposable insert shown at FIG. 5 which shows a matching disposable insert that is made from a thin layer of plastic or polymer such as the body of the pop drinks. This unit simply matches the size and shape of the cradle shown at FIG. 4 and will be easily placed inside it.

The purpose of this disposable insert is as follows.

1. It makes the use of these units easier so that the user does not need to waste time, energy and water for washing the whole cradle shown at FIG. 4.
2. This makes these units economical since a thin disposable piece will be cheap and affordable.
3. This makes these units clean and hygienic since the thin disposable piece will be disposed after use and thus will eliminate or decrease the chance of spread of germs and diseases.
4. This provides piece of mind to users when they know that a new unit is used for them alone.

These inserts may also have an optional handle cover 16 in order to go over the handle and prevent it from contamination. This handle cover has a door means hinged to it that will cover the lower surface of the handle and snap to its own wall so that even the handle part will be covered as well. Each part of this unit has a matching piece that will fit the parts of the unit shown at FIG. 5. The insert unit will overlap the side walls of the pans of the unit shown at FIG. 4 and will prevent it from being contaminated.

FIG. 6 shows schematically the top view of a dye pan means that is designed by making small spaces by dividing a pan or container into small spaces by use of dividing walls. This will function similar to the cylindrical spaces.

FIG. 7 shows schematically the cross cut view of the dye pan means shown in previous FIG. 6. In this view the small spaces 25 are shown made by use of dividing wall.

FIG. 8 shows schematically a brush means that has a re-useable handle means for use with a disposable brush means. The body of this brush means 27 holds a series of brush units 3. The re-useable handle means 26 has an attachment means 29 at its end 30 which allows the body of a disposable brush means 27 to be separated for disposal and to allow a fresh unit to be attached to the handle for use.

This method has following advantages.

1. It makes the use of these units easier, so that the user does not need to waste time, energy and water for washing the brush means.
2. It makes these units economical, since a disposable piece will be cheap and affordable.
3. This makes these units clean and hygienic, since the disposable piece will be thrown away after use and eliminates the chance of spread of germs and diseases.
4. This provides piece of mind to users when they know that a new unit is used for them alone.

FIG. 9 shows schematically the top view of the unit shown at previous FIG. 8. In this figure the re-useable handle means 26 is attached to the body of a disposable brush means 27 by use of the attachment means 29.

In another model shown at FIGS. 14-16 the base of the unit has a double sided surface that allows the brush means to be in its top and lower surfaces. It can also be made to have four sides with brush means.

FIGS. 10, 11 and 12 show schematically samples of special brush unit that are designed to carry a predesigned amount of the dye in their body for being transferred for application on the hair. This method may use many different kinds of these units, however in these views three examples are shown. FIG. 10 shows the side view of one example of a special brush unit which has a body or stem 31 which has a series of walls 32 around it. In this model each wall has a circular shape and goes around the stem or body 31 of the brush unit. The presence of two walls next to each other creates a space 33 between them which will hold a pre-designed amount of dye inside in it and become attached to the stem and walls themselves. The free end of the brush unit has a round head 34 so that it will not scratch the skin.

FIG. 11 shows schematically the side view of another brush unit which has a body or stem that consists of a combination of two separate stems 35 and 36 with a distance or space between them shown at 37 so that this space and adjacent stems will carry a predesigned amount of the dye. The free end of the brush unit, also has a round head 34 so that it will not scratch the skin.

FIG. 12 shows schematically the side view of yet another brush unit, which has a body or stem 38 that is covered with a layer of absorbent material such as the cotton shown at 39. This allows the following.

1. If this brush unit is immersed inside a pan of dye, it will hold a predesigned amount of dye and will allow the dye to be taken and delivered to the hairs.
2. Importantly, this unit can be used in a dry form. In this condition if it is brushed thorough a series of hairs which are covered totally with a hair dye, this unit will absorb the hair dye that comes in contact with it during its passage among the hairs. Thus it will remove the dye from certain hairs and will keep them from being dyed uniformly and this will create a differential coloring. The free end of this brush unit also has a round head 34 so that it will not scratch the skin.

FIG. 13 shows schematically a dye pan means or a tray means that consists of combination of two independent dye-containing areas for delivering the dye. This unit consists of two rather identical delivery systems that are divided by a separation wall 40. This unit has the following.

a. A series of cylindrical empty spaces 45 and 46 that are designed to allow each single, brush unit of the brush means shown at FIG. 1 to be inserted inside these cylindrical spaces in order to be immersed in the dye which is filling these spaces so that when the brush means is removed, each brush unit will be covered with a special predesigned amount of the hair dye. Thus the numbers of the cylindrical spaces will match the numbers of the brush units from the brush means.

b. A floor, which is a flat surface that the cylindrical spaces are attached to.

c. Pans 47 and 48 allow different colored hair dyes to be emptied inside each of them. A higher floor and wall similar to the unit shown at FIG. 2 will be utilized to allow this unit to be functional. The advantage of this unit is that it allows two different colors of hair dye to be placed and to be utilized with 1. A brush that has a matching numbers of brush units, here for example having four brush units, will be used once with the first dye in spaces 45 and then by the second dye in spaces 46.
2. Or with a brush that has enough numbers of the brush units that will allow half of the brush units to be used with the first dye in spaces 45 and the other half with the second dye in spaces 46.

The use of two dyes with different colors, allows two different colors and shades of these two colors to be applied to the hairs and prevent uniform coloring. Importantly, more than two colors may be used with utilizing this method. Importantly, this unit will also have a matching disposable insert similar to the unit shown at FIG. 5 that will sit inside this unit for use as explained in FIGS. 4 and 5.

FIG. 14 shows schematically a disposable body of brush means that is designed for use with a re-useable handle means shown at FIG. 15. In this model the body of the brush means 51 is a hollow flat cuboid made from a relatively rigid means that holds a series of brush units 3 on its upper and lower surfaces. This unit allows a re-useable handle means 57, shown at FIG. 15, to be used with it. This re-useable handle means has an insert part 56 that matches and fits the inner hollow space of the unit shown at FIG. 14. The tip of the insert part 56 will be pushed into the opening 53 of the unit shown at FIG. 14 until the insert part 56 fits inside the body of the brush. The sides of the body of the brush means has clip means 54 that will engage the zone between the neck 58 and the body of the insert 56 of the handle means shown at FIG. 15. This engagement will prevent the body of the brush means from being removed unless it is pulled out by holding the removal piece 55 designed for being held and pulling the body of the brush means 51 away from the insert 56. The handle means 57 has a handle that allows it to be held.

This method allows the user to use the brush means for the delivery, and the removal of the dye from the hair. One side of the brush means may be used for the delivery of the dye first and the other side may be used for the removal of some of the hair dye which is applied on the hair if it is desired. Importantly, the unit may have four sides covered with the brush means.

FIG. 16 shows schematically the cross cut of the disposable body of brush means shown at FIG. 14. In this figure, the body of the brush is shown at 51 and it has a hollow opening 53 for the placement of the insert 56. The top and the bottom surfaces of this piece have the brush units on them.

Figure 17:
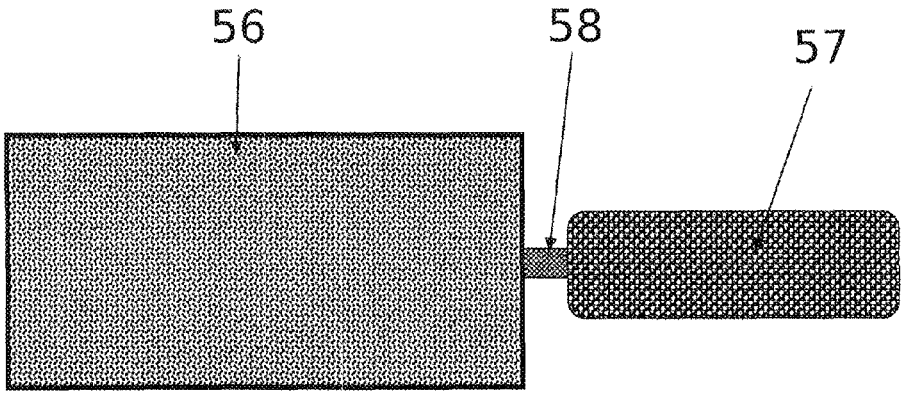
FIG. 17. shows the top view of the re-useable handle means, shown at FIG. 15.

FIG. 17 shows schematically the top view of the re-useable handle means shown at FIG. 15. In this figure, the insert is shown at 56, the handle means at 57 and the neck 58 between them.

Figure 18:
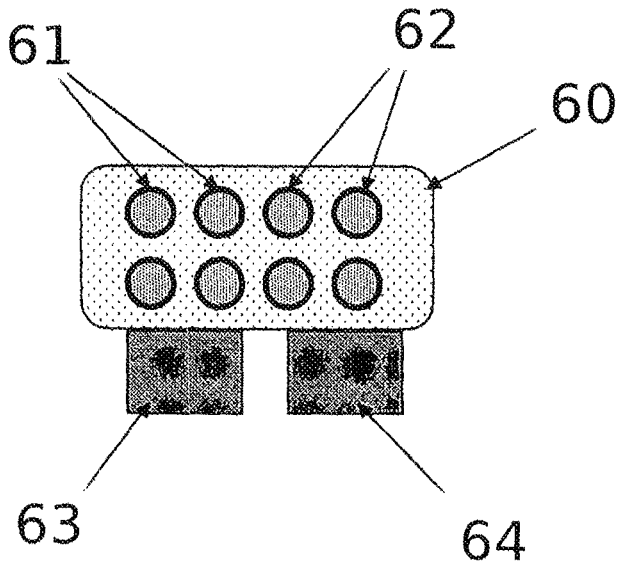
FIG. 18 shows schematically a modified, disposable brush means for use with the dye pan shown at FIG. 13.

FIG. 18 shows schematically a modified, disposable brush means for use with the dye pan shown at FIG. 13. In this model the brush means has a hollow body similar to the unit shown at FIGS. 14 and 16 and uses a handle means similar to the unit shown at FIGS. 14 and 16. The body of this unit shown at 60 is a flat, box-shaped body, made from a relatively rigid means that holds a series of brush units 61 and brush units 62 on it. By design, when used with pan shown at FIG. 13, the brush units 61 will carry different dye than the brush units 62. This unit will also have two blade means 63 and 64 for use with the respective dye pans 47 and 48.

Method of Use of these Units.

The use of the above mentioned units follows the following basic directions.

1. Initially, the user places the disposable pan means shown at FIG. 5 inside the durable pan means shown at FIG. 4 and closes the cover over the handle 12.
2. The user pours the hair dye inside the dye pan 7.

The user uses a brush means such as one shown at FIG. 3 and sweeps the hair dye from the piece 23 which fits to space 7 onto the floor 21 which fits to floor 6 to fill the pieces 22 of the disposable pan means fitting in cylindrical spaces 5. The user will choose a reasonable amount of the dye so that there will not be too much dye above the pieces 22.

3. The user places the brush means shown at FIG. 3 or preferably, the units shown at FIG. 8, 9 or 14-16 inside the filled pieces 22 so that the brush units 3 of the brush means will be immersed into the dye in order to hold a designated amount of the dye in their bodies.

4. The user will use the brush means with dye for brushing the hair. Importantly, since each brush unit 3 carries only a predesigned amount of the hair dye, thus per design, the hair dye will not spill from the brush means to contaminate the area. By repeating this action the user will dye the scalp, in a fashion which he or she wants.
5. By use of a dry brush means, particularly, a brush means made with an absorbent material such as the brush unit shown at FIG. 12, the user can remove lines of the hair dye which is already applied to the hair. Thus creating a series of hairs some part of which do not have the hair dye. Thus the coloring of the hair will not be uniform.
6. At the end, the user removes the disposable brush means shown at FIGS. 8-9 and 14-16 and the disposable insert of the pan means shown at FIG. 5 and then disposes the insert. This will leave the durable hair dye pan shown at FIG. 4 and the handle of the brush means FIGS. 14-16 ready for next use.

The use of the dye delivery pan with two different sets of the dye delivery systems as shown at FIG. 13 will be very similar except the user will use the dye from first or the second sets of the dye pans or simultaneously, in the way they want using one dye and mixing the other dye periodically as they wish.

FIG. 19 shows schematically a brush means that is made from a tube that has holes in its sides and tip properly located so that the hair dye can move into them or come out of them. Thus this shows the purpose of this invention in another form of brush means. Furthermore, it will allow a suction and delivery means such as one shown at 65 in order to suction away or deliver the dye. By doing so the dye (which is already delivered to the scalp) will be removed from the scalp in the direction of the movement of the brush means and thus the color of the hairs will be lighter. Thus with multiple and calculated use of this unit the hairs will have collection of hairs that are more or lesser dyed. In this model the brush unit consists of tubing with side holes 67 and an open end 68 which is connected to the suction-delivery machine 65 by a hose means 69. Machine 65 has control means that allows the important variables of suctioning or delivery to be controlled such as its vacuuming power, suction mode or delivery mode etc. In delivery mode this machine is capable of delivering the dye from a container through the holes and the openings of the brush unit 66 to the hairs, thus allows coloring to be done in a selected groups of the hairs. A disposable container symbolically shown at 71 will be able to function in two ways, A. In suctioning mode the machine will function as a suctioning means and will aspirate the dye into the container 71. The suctioned dye then will accumulate inside this disposable container 71 for disposal.
B. In delivery mode the dye will be placed inside this disposable container 71 so that with use of the suction-delivery machine the dye will be pushed and be delivered to the hairs.

The brush units will be disposable, so that they can be exchanged and disposed prior to next use.

FIG. 20 shows schematically a brush means that consists of a hollow body 73 which accepts multiple brush units 66 similar to the brush units shown at previous FIG. 19. The hollow body is connected to a piece 72 which will connect to the suction hose. This unit will allow the brush units to be exchanged and a new brush units to be used and then disposed after use. Alternatively, the whole unit shown in this figure will be disposable. Importantly, in some models the dye may be filled into the hollow body 73 and then either it will be squeezed out by use of a hand-held means or a machine to be delivered into the hairs.

DETAILED EXPLANATION OF THIS INVENTION

The coloring of hairs are common for beautification, religious reasons or expression of choices. Commonly, a single hair dye is applied to the hairs which leaves a uniform color on the hairs. However, a uniform hair color is not ideal in certain conditions, for example when the person wishes to have shades of hair coloring match the changes that happen in hair color with age. Also in another circumstance, when a person wishes to have a more artistic hair coloring than a uniform hair color. For those reasons this application introduces a method and means that allow differential coloring of the hairs to be done. This method can be achieved by two methods.

1. In first method, the applicant, uses a hand-held brush means shown at FIG. 1 to allow a predicted amount of hair dye to be carried to the hair for application. This brush means has a series of brush units 3 that are capable of holding a predicted amount of the hair dye for being taken and for being applied to the hairs. This method has the following advantages.

A. It allows the application of the dye to the hair to be easy.
B. It allows some groups of the hairs to be spared from being dyed since there is space between the brush units.

2. In a second method, the applicant uses a dry brush means in order to remove some of the hair dye which was already applied to the hairs. For this purpose the brush means, has a body made with brush means shown at FIG. 12. When this brush means is used in a dry condition, the absorbent body will remove the dye which is applied on the hair during its journey. Thus the hairs in course of the journey of this brush means will have no or lesser amount of the dye. With enough application finally the hairs will have different groups, some which has received full dose of the hair dyes and others with much lesser hair dye and a third group which has different shades of the hair dye on them. Thus at the end, this method allows the hairs to have shades of the hair dye on them and to look different than having a universal coloring.

The brush means consists as follows.

1. It has a base 2 made from a rigid material such as wood, metal or a polymer, which holds a series of special brush units 3. The unit has a handle 1 for holding it and also a blade 4 in its end. The blade is for wiping a dye into a special small space. The function of the brush means is as follows.

A. At the time of use, this brush means will be placed inside a pan with dye in a level that the dye reaches only to the base of the brush units 3. This makes the body of the brush units hold a predicted amount of dye so that the dye can be taken and delivered to the hairs. Thus by design, using this method will prevent the hair dye from dripping and contaminating unwanted areas. With the consistency of the dye and the calculated surface area or the porous nature of the brush units 3, the dye amount on the brush unit 3 will not allow the dye to drip. Thus the application of the dye to the hairs will be easier, without dripping and messing the surrounding area. The removal of the dye with each application will reduce the level of the dye in a regular flat pan to a level that at some point the level of the dye on the pan will be so low that it will be only enough to reach the tip of the brush units 3. To prevent such a phenomenon, the applicant introduces a special pan means shown at FIG. 2 that allows a consistent amount of the dye to be delivered by this brush means, each time, until the very last use. This prevents wasting the dye as well. Thus overall a lesser amount of dye can be used.

B. By this method each brush unit 3 will carry the hair dye to some distance around the brush units 3. Thus with choosing a proper distance between the brush units 3, some groups of the hairs will be spared from being dyed. This allows hairs with two different colors and shades in between.

C. By using a new brush means covered with the absorbent material around its brush units 3 as shown in FIG. 12 or any brush unit multiple times, each time with a new brush means, this will function such that it will remove some of the hair dye which has already been applied to the hairs, during the passage of the brush means among the hairs. Thus by multiple application of such a unit in dry condition, finally the hairs will have different groups, some which has received full dose of the hair dyes and others with much lesser hair dye and a third group which has different shades of the hair dye on them. With mixing them a natural look will appear and a universal coloring will be prevented.

FIG. 2 shows schematically a pan means, designed to simplify and facilitate the process of the carrying of the hair dye to the hairs and prevent from contamination of the unwanted areas. Also it allows the least amount of the dye to be used for dying the hairs. This unit consists of a pan with different parts as follows.

a. a series of cylindrical empty spaces 5 that are designed to allow a single brush unit 3 of the brush means shown at FIG. 1 to be inserted inside these cylindrical spaces in order to be immersed in the dye which is filling these spaces. After the removal, only a predicted amount of the dye will attach to the body of the brush unit 3 so that when the brush means is removed, each brush unit 3 will carry only a special, predesigned amount of the hair dye. The numbers of the cylindrical spaces 5 will match the numbers of the brush units 3 from the brush means.

b. A floor 6 which is a flat surface which is the base for the first or the lower pan and the cylindrical spaces are attached to it. This floor will create the base of the first pan.

c. The front part of the floor 6 has a dye pan 7 that allows initially, the hair dye to be emptied inside it for use. This pan has front and rear ramps that allow a blade such as the blade 4 from the brush unit in FIG. 1, to pull the dye from the base of the pan onto the flat surface 6 in order to fill up the cylindrical spaces.

d. A second flat floor 11 which stands above the first floor 6 and prevents that dye from spilling out of this unit. This is the base of the second pan.

e. A surrounding wall 10 is around the second floor 11 and makes the wall of the second pan and further prevents the dye from being spilled out of this unit.

f. A handle 12 allows this unit to be held.

FIGS. 3, 4 and 5 are designed to show pieces of a complete system for use by this method. FIG. 3 shows schematically a brush means similar to the unit shown at FIG. 1 which matches the dye delivery tray means shown at FIG. 4. In this unit the size, the location, the distances between the brush units 3 and the numbers of the brush units 3 all are designed to allow this brush means to fit inside the tray means shown at FIG. 4.

FIG. 4 shows schematically, the side view of the dye delivery pan means shown at FIG. 2. This figure shows two pans made by having walls around the floors 6 and 11 respectively so that the walls prevent the dye from spilling out of these pans. The cylindrical spaces 5 are attached to the floor 6 of the lower pan. Again each cylindrical space allows one brush unit 3 of the brush means shown at FIGS. 1 and 3 to be inserted inside it for being immersed in the dye which fills these spaces. The upper pan stands above the lower pan and has its own side wall 10. The handle means 12 is attached to the side of the upper pan.

The front part of the floor 6 has the dye pan 7 with its two ramps. The ramps are designed to allow the blade 4 from the brush unit to sweep the dye from the dye pan 7 and bring it up using the ramp 8 to the surface of floor 6 and then to move the dye for filling up the cylindrical spaces 5.

Please note that in this model this unit is made from a rigid material such as metal or synthetic material to be durable and although it can be used alone, mainly this unit is designed to function as a cradle for a matching disposable insert shown at FIG. 5 so that the disposable piece can be inserted into this durable unit and used. By this method, the disposable insert can be discarded after use, leaving the durable piece clean and useable.

FIG. 5 shows a disposable insert made from a thin synthetic material that matches and simply will fit inside the cradle means shown at FIG. 4. Thus naturally the shape and the buildup of this unit will match to allow such use. The idea behind the use of this insert is as follows.

1. Eliminating the need for washing the unit. By removing and disposing the insert, the user does not need to waste time for washing the whole cradle unit shown at FIG. 4. It can be imagined that cleaning the empty spaces simply will be a very demanding job.
2. This makes these units economical, since a thin disposable piece will be cheaper and affordable. There will be no need to waste water, contaminate sewage system etc.
3. This makes these units clean and hygienic, when it is used in barber shops, since the thin disposable piece will be disposed after each use, and thus it will eliminate or very significantly, decrease the chance of spread of germs.
4. In barber shops, it will provide piece of mind to the users when they know that a new unit is used for them alone.

Using the logics, there is not much explanation needed for the shape of these inserts since their body and shape simply will match the inside surface of the durable unit shown at FIG. 4 and this piece will simply fit inside it. The edges of the upper sidewalls of the insert will overlap the sidewalls of the durable piece to prevent contamination of the sidewalls of the durable piece. The unit may have a handle cover 16 which will go over the handle of the durable unit to prevent it from contamination. The handle cover means has a door means hinged to it at 17 that will cover the lower surface of the handle and snap to its own wall, so that the handle part will be covered totally. Alternatively, a thin vinyl envelope can be pulled over the handle, to prevent from its contamination.

FIGS. 6 and 7 show a simple divided pan which may be used in some circumstances for this purpose. It is to show that the pan means may be made in a different shape. FIG. 6 shows schematically the top view of a dye pan means with small spaces are created by dividing a pan by walls. FIG. 7 shows schematically the cross cut view of the dye pan means shown in previous FIG. 6.

FIGS. 8, 9, 14 and 16 are designed to show a method which allows a disposable brush means to be used with re-useable handle means so that this will be more economical. In this method the re-useable handle means will be connected or attached to the body of a disposable brush means for use when the disposable brush means can be disconnected from the handle means for disposal and the handle means can be re-used with another disposable brush means.

FIG. 8 shows schematically a brush means that has a re-useable handle means which attaches to the body of a disposable base 27 which holds a series of special brush units 28 on it. The re-useable handle means 26 has an attachment means 29 at its end 30. The attachment means allows the body of a disposable base 27 to be separated from the handle and to allow a new unit to be attached for use. The advantage of this method is that it allows lesser amount of the material to be wasted. Handle means 26 is attached to the body of a disposable base 27 by use of the attachment means, 29.

In another model, shown at FIGS. 14 and 16, the brush means has a body with a double-sided surface that allows the brush means to be in its top and lower surface. The handle means will be inserted inside the body of the brush means. Importantly, the body of the brush means may be made to have three or four sides or more with brush means. It may be even made to be cylindrical.

FIG. 10 shows schematically the side view of a single special brush unit which has a body or a stem shown at 31 with a series of short, circular walls 32 that are located around the stem and are perpendicular to it. The presence of walls close to each other creates a space 33 between them for holding a pre-designed amount of dye in it, due to the consistency of the dye. The free end of the brush unit has a rounded head 34 so that it will not scratch the skin. Importantly, instead of the walls the stem may be made to have other means such as, a. Short, multiple side branches.
b. Spikes.
c. Indentations
d. Holes or openings.
e. Spaces.

or any other means to increase the surface of the stem and modify its surface to allow the temporary attachment of the dye to the stem and its parts and the surfaces for delivery to the intended area.

Importantly, any other means and modification which will be useful in the purpose may be used to make such units applicable.

FIG. 11 shows schematically the side view of another brush unit, which has a body that consists of combination of two separate stems 35 and 36 with a distance between them, shown at 37, so that the surfaces of the stems and the adjacent space between them will hold a predesigned amount of the dye for delivery. The end of the brush unit also has a round head 34 so that it will not scratch the skin.

FIG. 12 shows schematically the side view of another model of brush unit which has a body or stem that is covered with a layer of absorbent material such as the cotton shown at 39. This allows the following.

If this unit is placed inside a pan of dye, it will hold a certain amount of dye, based on its thickness and pre-designed make-up, which is to be taken and delivered to the hairs.

1. Importantly, if it is brushed in a dry condition, thorough a group of hairs which are covered totally with a hair dye, this unit will absorb the hair dye during its passage among the hairs. Thus it will remove the dye from certain hairs and will keep them from being dyed uniformly, and will create a differential coloring. The free end of this brush unit also has a round head 34 so that it will not scratch the skin.

Method of Application of Two Dyes Simultaneously.

This method uses a pan means introduced in this application as shown at FIG. 13. This dye pan means consists of a combination of two adjacent, independent dye pans 41 and 42 for delivering the dye, which are basically very similar to the dye pan means shown at FIG. 2. They are separated by a separation wall 40. This unit has the following:

a. a series of cylindrical empty spaces 45 and 46 that are designed to allow a single brush unit 3 of the brush means shown at FIG. 1 to be inserted inside these cylindrical spaces in order to be immersed in the dye which is filling these spaces so that when the brush means is removed, each brush unit 3 will be covered with a special predesigned amount of the hair dye. The brush units 3 in front half will have one color and the brush units 3 in the rear half another color. Thus the numbers of the cylindrical spaces will match the numbers of the brush units from the brush means. A floor 43 and a floor 44 are flat surfaces to which the cylindrical spaces 45, 46 attach.
b. Pans 41 and 42 will allow different colored hair dyes to be emptied inside each one. A higher floor and wall similar to the unit shown at FIG. 2 will be utilized to allow this unit to be functional. The dye pans have ramps 49 and 50 similar to the unit shown at FIG. 2. The advantage of this unit is that it allows two different colors of hair dye to be placed and to be utilized with 1. A brush that will be used once with first dye in spaces 45 and then with the second dye in spaces 46.
2. Or with a brush that has enough numbers of the brush units that will allow half of the brush units to be used with the first dye in spaces 45 and the other half with the second dye in spaces 46.

The brush means for use with this unit will be very similar to the model shown at FIG. 1. It will have a total numbers of the brush units that matches the total numbers of the cylindrical empty spaces, 45 and 46 in this model. The blade of this brush means can be made from two separate blades, located in the side of the brush means as shown at FIG. 18 and in a spot that will match the location of the dye pans 41 and 42 of this pan means.

The use of two dyes with different colors will allow two colors and shades of these two colors to be applied to the hairs and prevent from a uniform coloring. Importantly, more than two colors may be used with utilizing this method.

FIG. 14 shows schematically a disposable brush means that is designed for use with a re-useable handle means shown at FIG. 15. In this model the brush means has a hollow body 51 made of a flat, box-shaped body made from a relatively rigid means that holds a series of brush units 52 on its upper and lower surfaces. This unit has an opening 53 that allows the insert part 56 of the re-useable handle means shown at FIG. 15 to be inserted into it for use. The shape and size of the insert 56 matches and fits to the hollow space of this unit for proper handling. The tip of the insert 56 will be pushed into the opening 53 of the body 51 until the insert is totally in place. An engagement means schematically shown at clip means 54 will engage with the neck 58 of the handle means to keep these units together during use. Body 51 will pulled out of the handle after use by holding the end piece 55 designed for being held and pulling it away from the insert 56. One side of the brush means may be used for the delivery of the dye and the other side may be used for the removal of the extra dye. Importantly, the unit may have three, four or more sides with brush means or it may be made to be cylindrical.

FIG. 15 shows schematically the side view of a handle means 57 for use with the disposable brush means shown at FIG. 14. This unit is a re-useable and has a handle for being held comfortably and a relatively rigid body shown at 56 that matches and fits inside the body 51 of the brush means shown at FIG. 14 and allows it be manipulated easily. The unit has a neck 58 with proper design for allowing the body of the brush to engage with the handle means. The advantage of this unit is economical, since it is re-useable. The top view of this unit is shown at FIG. 17.

FIG. 16 shows schematically the cross cut side view of the body 51 of the disposable brush means shown at FIG. 14. In this figure the body 51 is shown with its hollow space 53 that accepts the insert 56 of the handle means 57. The brush units 52 are attached to the upper and the lower surfaces of this unit. The side blade is shown at 59.

FIG. 17 shows schematically the top view of the handle means shown at FIG. 15. This figure shows the rather wide body of this unit which matches the width of the body of the disposable brush means shown at FIG. 16.

FIG. 18 shows schematically a modified disposable brush means for use with the dye pan shown at FIG. 13. In this model the brush means also has a hollow body similar to the unit shown at FIG. 16 and uses a handle means similar to the unit shown at FIGS. 15 and 17. The body of this unit shown at 60 has a flat, box shape made from a relatively rigid means that holds a series of brush units 61 and brush units 62 on it. By design, when used with the pan shown at FIG. 13, the brush units 61 will carry different dye than the brush units 62. This unit will also have two blade means 63 and 64 for use with dye pans 41 and 42.

Method of Use of these Units.

A method of use of the tray means of FIG. 4 for applying dye to the brush of FIG. 3 has already been described. The brush of FIGS. 14 and 16 can be used with that tray means. The brush of FIG. 18 can be used with the pan means of FIG. 13 in a similar way with brush units 61 and blade means 63 being used with pan 41 and brush units 62 and blade means 64 being used with pan 42. The two side-by-side dye delivery systems can be used with dye from first pan, from the second pan or simultaneously from both in the way desired using one dye and mixing the other dye periodically.

The advantages that these units.

1. This system allows an easy means of delivering the dye to the hairs and prevents from dripping the dye. Thus the user can apply the dye without fear of contaminating the surrounding that otherwise can happen.
2. Provides differential coloring that is advantageous for creating a desired result.
3. Allows the application of different dyes by use of one pan means and delivery system.
4. It makes the process of the application of the dye easy and more controlled. The user can use this system and apply the dye only to the areas that he or she wants.
5. Importantly, it allows the last remaining of the hair dye to be also utilized efficiently, since this method allows the last amount of the dye to be swiped into the cylindrical spaces and utilized which is not possible by use of the ordinary means such as pans. This prevents wasting of the hair dye and decreases the costs of this process.
6. Importantly, this method may be used in other conditions and uses than the hair coloring as well whenever it can be applied.

Importantly the size, thickness, nature of the brush units, relative sizes, the distances between the brush units, the materials and other important parts of these units may vary in order to make different useful units. The modification of this invention can be done to make it useful for other purposes and uses, other than the hair coloring as well.

The Use of Hollow Brush Means

The applicant introduces the hollow brush units that may be also used for the delivery and suctioning of the dye. For this purpose one or more of such brush units will be used with machine that is capable of aspirating and delivering a liquid or gel type dye to the hairs. The prototype of this model is shown at FIGS. 19 and 20.

FIG. 18 shows schematically a brush means that is made from a tube that has holes in its sides and tip, properly located so that the hair dye can move into them or come out of them. Thus this will function for the purpose of this invention as the other brush means. Furthermore, it will allow a suction and delivery means such as one shown at machine 65 to suction away or deliver the dye. By doing so the dye (which is already delivered to the scalp) will be removed from the scalp in the direction of the movement of the brush means and thus the color of the hairs will be lighter. Thus with multiple and calculated use of this unit the hairs will have collection of hairs that are more or less dyed. In this model the brush unit 66 consists of tubing with side holes 67 and an open end 68 which is connected to the suction-delivery machine 65 by a hose means 69. The machine has control means 70 that allows the important variables of suctioning or delivery to be controlled such as its vacuuming power, suction mode or delivery mode etc. In delivery mode this machine is capable of delivering the dye from a container 71 through the holes and the openings of the brush units to the hairs, thus allowing coloring to be done in a selected groups of the hairs. A disposable container symbolically shown at 71 will be able to function in two ways, A. In suctioning mode the machine will function as a suctioning means and will aspirate the dye into the container. The suctioned dye then will accumulate inside this disposable container for disposal.
B. In delivery mode the dye will be placed inside this disposable container so that with use of the suction-delivery machine the dye will be pushed and be delivered to the hairs.

The brush units will be disposable, so that they can be exchanged and disposed prior to next use.

FIG. 20 shows schematically a brush means that consists of a hollow body 73 which accepts multiple brush units 66 similar to the brush units shown in previous FIG. 19. The base is connected to a piece 72 which will connect to the suction hose. This unit will allow the brush units to be exchanged and a new brush unit to be used and then disposed after use. Alternatively, the whole unit shown in this figure will be disposable. Importantly, in some models the dye may be filled into the hollow body 73 which then either will be squeezed out or by use of a hand-held means or a machine to be delivered into the hairs.

Importantly, the issue of the rounding the head of the brush units is to use a method to prevent hurting the scalp. Thus in some units this goal may be achieved by rounding the head of the brush unit rather than having another piece added to it.

Importantly the size, thickness, nature of the brush units, relative sizes, the distances between the brush units, the materials and other important parts of these units, the other important parts of the pan means and the other units mentioned in this application may be modified in order to make different and more useful units. The modification of this invention is also possible for making units for other purposes and uses, other than the hair coloring as well.

That invention claimed is:

1. The combination of a brush for applying hair dye to hair, and a dye-holding pan, the brush comprising a base and multiple dye-holding units disposed on the base in a pattern comprising multiple side-by-side rows with each row comprising multiple dye-holding units;

the dye-holding pan comprising multiple open-top receptacles for holding hair dye that are arranged on the base in a pattern comprising multiple side-by-side rows with each row comprising multiple receptacles arranged in a pattern that allows the dye-holding units to be inserted into the receptacles on a basis of only one dye-holding unit to one receptacle.

2. A brush and pan as set forth in claim 1 in which the pan comprises a ramp that inclines downward and away from the open tops of the receptacles to a supply pan portion for holding dye that is used to fill the receptacles through the open tops.

3. A brush and pan as set forth in claim 2 in which the brush comprises a handle at one end of the base and a blade at an opposite end of the base that is shaped for wiping along the ramp after being placed in dye in the supply pan portion to draw dye along the ramp and into open tops of the receptacles.

4. A brush and pan as set forth in claim 3 in which the pan comprises two sets of receptacles and two supply pan portions, and a partition that separates one of the sets of receptacles and one of the supply pan portions associated with the one set of receptacles from the other of the sets of receptacles and the other supply pan portion.

5. A brush and pan as set forth in claim 3 in which the pan comprises a planar floor which contains the open tops of the receptacles and across which dye can be drawn by the blade so as to allow dye to fill the receptacles to a common level.

6. A brush and pan as set forth in claim 2 further including a disposable liner fitting to the receptacles and the supply pan portion for holding dye.

7. A brush and pan as set forth in claim 2 in which the brush comprises a handle at one end of the base and the pan comprises a handle that can be grasped by a person's hand for holding the pan and that extends from the pan transversely to the handle of the brush when the dye-holding units are disposed in the receptacles.

8. A brush and pan as set forth in claim 1 in which the brush comprises a handle at one end of the base and the pan comprises a handle that can be grasped by a person's hand for holding the pan and that extends from the pan transversely to the handle of the brush when the dye-holding units are disposed in the receptacles, and further comprising a cover covering at least a portion of the handle that is intended to be grasped by a person's hand.

9. A brush and pan as set forth in claim 8 in which the cover is part of a disposable liner fitting to the receptacles.

10. A brush and pan as set forth in claim 9 in which the cover comprises an overlying portion for overlying the handle and an underlying portion that is hinged to the overlying portion and can be swung into underlying relation to the handle after the overlying portion has been placed to overlie the handle.

* * * * *